US009222658B2

(12) United States Patent
Midy et al.

(10) Patent No.: US 9,222,658 B2
(45) Date of Patent: Dec. 29, 2015

(54) HYBRID SOCKET WITH LOCKING FUNCTION FOR SINGLE-FILAMENT OR DUAL-FILAMENT BULB

(75) Inventors: Olivier Midy, Rochefort sur Loire (FR); Nicolas Pasquier, Avrille (FR)

(73) Assignee: TBI, Les Neyrolles (FR)

( * ) Notice: Subject to any disclaimer, the term of this patent is extended or adjusted under 35 U.S.C. 154(b) by 69 days.

(21) Appl. No.: 14/128,770

(22) PCT Filed: Jun. 29, 2012

(86) PCT No.: PCT/FR2012/051515

§ 371 (c)(1),
(2), (4) Date: Apr. 14, 2014

(87) PCT Pub. No.: WO2013/001249

PCT Pub. Date: Jan. 3, 2013

(65) Prior Publication Data

US 2014/0254138 A1 Sep. 11, 2014

(30) Foreign Application Priority Data

Jun. 30, 2011 (FR) ..... 11 02038

(51) Int. Cl.

| | |
|---|---|
| ***H01R 13/625*** | (2006.01) |
| ***F21V 23/06*** | (2006.01) |
| ***H01R 33/09*** | (2006.01) |
| ***H01R 33/965*** | (2006.01) |
| ***H01R 33/97*** | (2006.01) |
| ***F21S 8/10*** | (2006.01) |
| *H01R 33/72* | (2006.01) |

(52) U.S. Cl.

CPC ..... *F21V 23/06* (2013.01); *F21S 48/1109* (2013.01); *H01R 33/09* (2013.01); *H01R 33/965* (2013.01); *H01R 33/97* (2013.01); *H01R 33/72* (2013.01); *H01R 2201/26* (2013.01)

(58) Field of Classification Search

CPC ..... H01R 33/09; H01R 33/965; H01R 33/72; H01R 33/97; F21V 23/06

USPC ..... 439/220–223, 336; 362/95

See application file for complete search history.

(56) References Cited

U.S. PATENT DOCUMENTS

| | | | | |
|---|---|---|---|---|
| 3,982,813 | A * | 9/1976 | Cope et al. | 439/548 |
| 4,804,343 | A * | 2/1989 | Reedy | 439/854 |
| 6,162,084 | A * | 12/2000 | Chen et al. | 439/336 |
| 6,461,027 | B1 * | 10/2002 | Yagi et al. | 362/505 |
| 8,632,364 | B2 * | 1/2014 | Lee et al. | 439/619 |
| 2002/0019158 | A1 * | 2/2002 | Okamoto | 439/336 |
| 2010/0027279 | A1 * | 2/2010 | Kotera et al. | 362/418 |

FOREIGN PATENT DOCUMENTS

WO 2011028053 A2 3/2011

* cited by examiner

*Primary Examiner* — Chandrika Prasad
(74) *Attorney, Agent, or Firm* — Bachman & LaPointe, P.C.

(57) ABSTRACT

The present invention relates to a hybrid socket for a single-filament or dual-filament bulb consisting of a body made of an insulating material, exhibiting a front cavity for introducing the bulb, of substantially rectangular shape, complementary to the exterior shape of the base. It comprises at least one stopper of complementary cross section to that of the cavity of circular cross section, each traversed by a supply wire crimped onto a metallic contact of a first type, and a third stopper of complementary cross section to that of the cavity of oblong cross section, crimped onto an earth metallic contact. The socket furthermore comprises a locking hook for the bulb. Application: socket for type T20 blinking indicator lights or side lights.

7 Claims, 6 Drawing Sheets

HYBRID SOCKET WITH LOCKING FUNCTION FOR SINGLE-FILAMENT OR DUAL-FILAMENT BULB

BACKGROUND

Field of the Invention

The present invention relates to the field of electrical connection equipment, and more particularly to electrical connectors and sockets.

It relates in particular to the field of electrical sockets in the automobile field, especially the sockets for a mixed use for type T20 single-filament or dual-filament bulbs with W3×16D W3×16q, WY3×16q and W×3×16d type bases for example. These bulbs are used in particular for the rear and front directional signals and side light bulbs, brake lights, back-up lights and side repeater. They are also intended for daytime signalling of vehicles, since such bulbs are particularly resistant to high temperatures.

These lamps consist of a glass bulb traversed by metallic wires extending the legs supporting the filament(s). Such bulbs exhibit no metallic base or additional portion. The linking area between the base of a substantially rectangular cross section and the bubble exhibits a shoulder intended for the engagement of the bulb into the socket. The base also exhibits a foolproofing protrusion, the height and width of which are defined by the nature of the bulb (dual-filament or single-filament).

Waterproof sockets are known in the prior art, which consist of a base exhibiting a single cavity for the passage of the supply wires. These supply wires traverse a single sealing stopper at three separate holes. The single stopper is then forced into the cavity to seal the socket.

The disadvantage of these sockets of the prior art is that assembling the wires requires an operation, which cannot be automated but with difficulty, consisting of first preparing the sealing stopper. This step of manual preparation consists in inserting the free end of each wire, crimped onto the corresponding contact, into one of the holes of the stopper provided for this purpose. Then, the contacts are positioned in the socket, before the introduction of the stopper.

The free end is then crimped to complete the assembly.

These sockets of the prior art are not suitable for an advanced automation of manufacture, which results in high production costs.

Sockets were also provided in the prior art, the rear end of which was open to enable the manual assembling of the supply wires and the contacts. The cavity was then filled with a resin embedding the supply wires and filling the cavity provided for the introduction of the contacts.

This solution is not totally satisfactory because it involves an operation, consisting in adding resin, executed by a special machine. In addition, under certain conditions, a lifting of the resin from to the cavity formed in the socket has been observed, which might result in loss of tightness.

The patent application PCT WO2011/0280053 is more particularly known in the state of the art, which describes a bulb socket, optimized to improve the earthing (grounding) performances, in spite of the vibrations taken during use. The bulb comprises a connector projecting from a lower end of the light emitting element, and has, at each of a front surface and a rear surface thereof, a pair of parallel resilient terminals. The socket comprises a resilient support terminal unit positioned at an inner wall surface of a coupling cavity defined within the socket and used for resiliently supporting the connector inserted in the coupling cavity while producing an electrical connection with the electrical terminals. Any one of each pair of electrical terminals is pressed and supported by the resilient support terminal unit at a height different from that of the adjacent electrical terminal positioned on the same surface of the connector and the other electrical terminals positioned on the opposite surface of the connector.

SUMMARY

To overcome the disadvantages of the prior art, the invention, in its broadest sense, relates to a hybrid socket for a single-filament or dual-filament bulb consisting of a bubble made of glass extended by a base made of glass and exhibiting at least one pair of wires traversing the base and each one folded over one face of the base to form a metallic contact parallel to the longitudinal axis of the bulb. The socket consists of a body made of an insulating material, exhibiting a front cavity for introducing the bulb of substantially rectangular shape complementary to the exterior shape of the base. The insulating body exhibits fastening means on a reflector and a flange for receiving a seal providing tightness with the reflector.

The cavity exhibits a longitudinal groove for engagement of a locking hook with the bulb. The rear portion of said body exhibits at least one longitudinal cavity of circular cross section and a longitudinal cavity of oblong cross section. The socket furthermore comprises at least one stopper of complementary cross section to that of the cavity of circular cross section, each one of said stoppers being traversed by a supply wire crimped onto a metallic contact of a first type and a third stopper of complementary cross section to that of the cavity of oblong cross section, crimped onto an earth metallic contact.

The contacts of the first type consist of a metallic leaf spring folded and cut to form at least one current pick-up pad and a locking hook.

The earth contact consists of a metallic leaf spring folded and cut to form at least one current pick-up pad and a locking hook adapted to engage with a first shoulder of the bulb. The socket furthermore consists of a locking hook consisting of a metallic leaf spring folded and cut to enable the insertion thereof through the front face of the insulating body, with said locking hook being adapted to engage with a second shoulder of the bulb 9, arranged on the opposite face of the base, relative to said first shoulder.

The invention differs from the prior art more particularly in the following characteristics:

- each contact of the first type consists of a metallic leaf spring folded and cut to form a current pick-up pad, and a locking pawl;
- the earth contact consists of a metallic leaf spring folded and cut to form at least one current pick-up pad and a locking hook adapted to engage with a first shoulder of the bulb;
- the cavity exhibits a longitudinal groove for engaging a locking hook for the bulb; and
- the socket furthermore comprises a locking hook consisting of a metallic leaf spring folded and cut to enable the insertion thereof through the front face of the insulating body, said locking hook being adapted to engage with a second shoulder of the bulb, arranged on the opposite face of the base, relative to said first shoulder.

According to a first alternative solution, said earth contact consists of a metallic leaf spring folded and cut to form a single laterally offset current pick-up pad, and a locking hook adapted to engage with a first shoulder of the bulb, the socket furthermore comprising a solid wall to seal one of the cavities of circular cross section, for use with a single-filament bulb.

According to a second alternative solution, said earth contact is formed by a metallic leaf spring folded and cut to form two current pick-up pads, offset laterally on either side of the median and a locking hook adapted to engage with a first shoulder of the bulb for use with a dual-filament bulb.

Advantageously, the oblong cavity exhibits two longitudinal guide wings to ensure the correct positioning of the earth contact.

Preferably, the circular cavities exhibit two longitudinal guide wings to ensure the correct positioning of the contacts of the first type.

According to a particular embodiment, said front cavity for inserting the bulb exhibits lateral guide zones arranged longitudinally to ensure the guiding of the shorter sides of the bulb base.

According to another alternative solution, said front cavity for introducing the bulb, exhibits adjustment protrusions positioned to come into contact with the electrical contacts of the bulb.

BRIEF DESCRIPTION OF THE DRAWINGS

The present invention will be better understood upon reading the following description, while referring to the appended drawings concerning non restrictive embodiments wherein.

DETAILED DESCRIPTION

Figure 1:
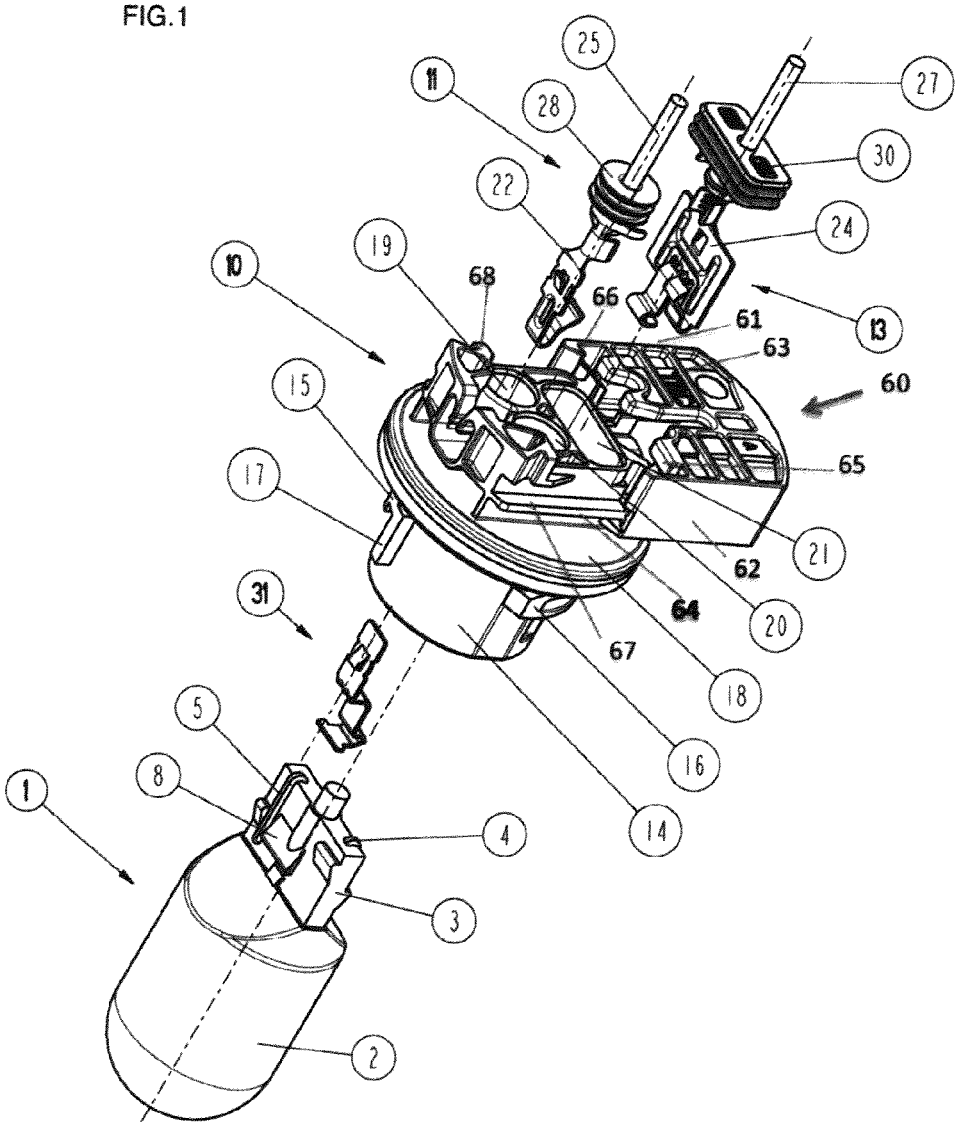
FIG. 1 shows an exploded view of a socket with its bulb in a single-filament use.
Figure 2:
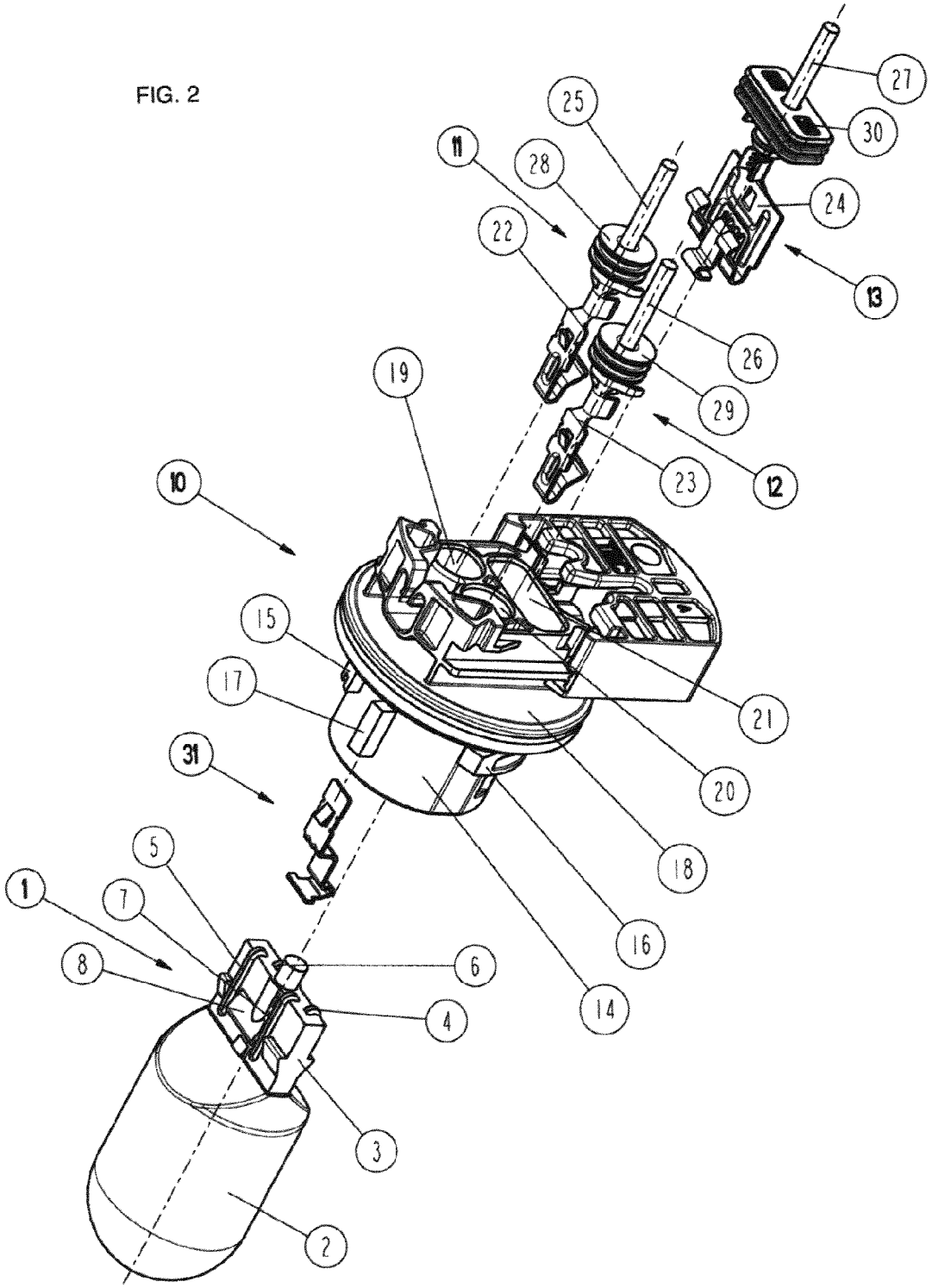
FIG. 2 shows an exploded view of a socket with its bulb in a dual-filament use.

FIGS. 1 and 2 show exploded views of a socket, according to the invention, respectively for use with a T20 single-filament bulb, and for use with a T20 dual-filament bulb.

The socket according to the invention is characterized in that the same body enables use for both bulbs, without any modification of the insulating body, except for the closing or not of one of the rear cavities. This enables a reduction in the mould designing and manufacturing costs. The mould can be adapted by adding or removing a matching part.

The assembly described in FIGS. 1 and 2 first comprises a bulb 1 of the T20 type exhibiting a bubble 2 extended by a base 3. This assembly, consisting of the bubble 2 and the base 3, forms a single moulded piece made of glass. The base 3 is traversed by metallic extensions of the filament supports, respectively an earth (ground) electrical contact 4 and a supply electrical contact 5 of the first filament, and for dual-filament bulbs, a second earth (ground) electrical contact 6 and a second supply electrical contact 7 of the first filament. The base exhibits on either side a shoulder 8 for adjusting the bulb in a socket.

The assembly also includes a socket consisting of:

an insulating body 10 one or two supply means 11, 12 a means 13 for connection to earth (ground).

The insulating body 10 is a part moulded in plastic, for example polybutylene terephtalate (PBT) with a load of about 30% by weight of glass fibres, or of 4.6 type polyamide.

It exhibits a front zone 14 of a substantially tubular shape, provided at its exterior surface with locking pins 15, 16 and a foolproofing pin 17 specific to the type of bulb (single- or dual-filament). Such tubular portion 14 is extended by a flange 18 whereon a seal providing tightness with the reflector is placed, when the socket is mounted onto the reflector.

The rear portion of the insulating body 10 exhibits three longitudinally oriented cavities 19, 20, 21.

The first two cavities 19, 20 are intended for the passage of the supply wire of the two filaments (for the dual-filament application). For the single-filament application, one of the cavities 20 is closed by a wall formed during the moulding of the part. For the bi-filament applications, the insert forming the wall is removed from the mould to form a through cavity.

The third cavity 21 exhibits an oblong cross section. It is intended for the passage of the earth contact 24.

Finally, the socket comprises one or two supply contacts 22, 23 and an earth contact 24 crimped onto supply wires respectively 25, 26 and 27. Each of the wires 25 to 27 is respectively engaged in a stopper 28 to 30.

The stoppers 28, 29 intended for the supply wires 25, are standard cylindrical stoppers exhibiting deformable peripheral lips for sealingly fitting to the inner surface of the receiving cavity.

The stopper 30 for the earth wire 27 is a specific stopper, of a substantially parallelepiped shape, also exhibiting the deformable peripheral lips for sealingly fitting to the inner surface of the receiving cavity.

Finally, the socket comprises a metallic locking hook 31, completing the adjustment of the base 3 with respect to the insulating body.

Figure 3:
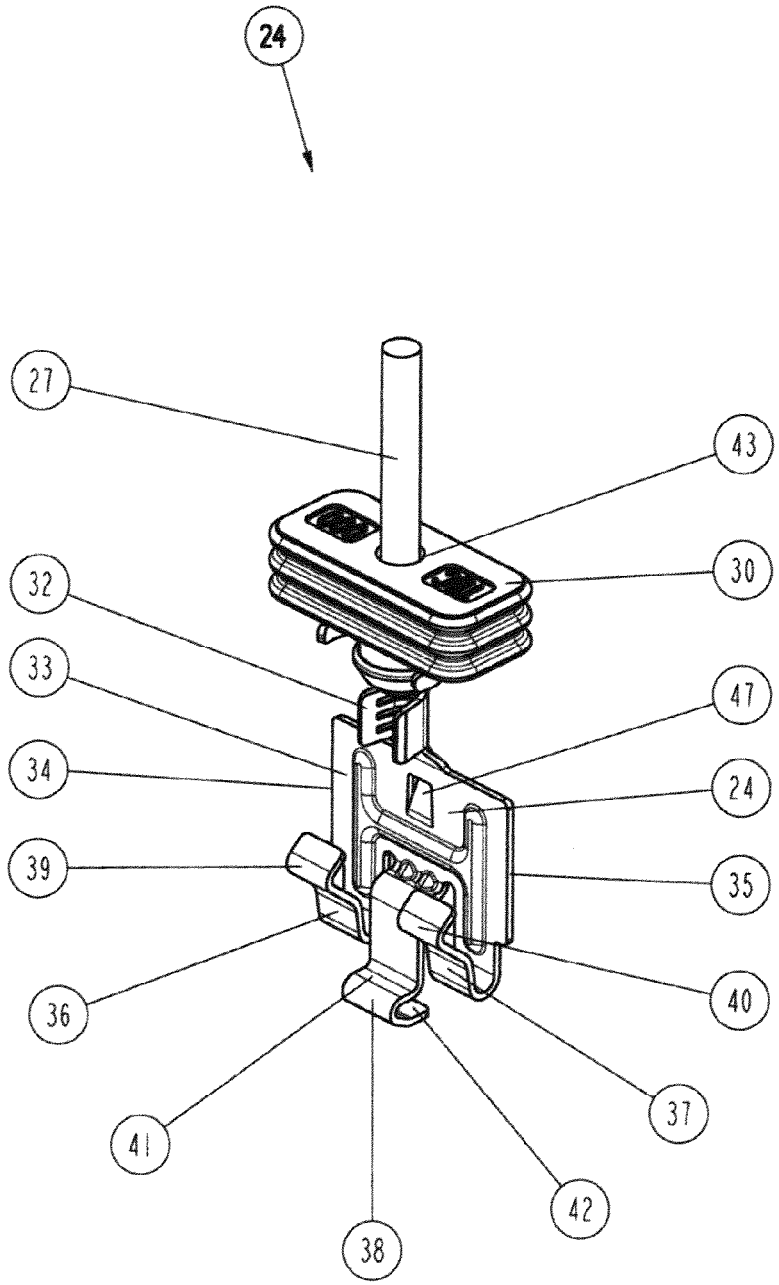
FIG. 3 shows a detailed view of the earth contact and its stopper.

FIG. 3 shows a detailed view of the earth (ground) contact 24 crimped onto the electrical wire 27 inserted into the stopper 30.

This earth contact (electrical ground contact) consists of a metallic leaf, for example made of bronze, cut and folded to exhibit a crimping zone 32 extended by a rectangular guide zone 33. This guide zone 33 exhibits, on both sides, wings 34, 35 engaging with a complementary receiving zone formed in the cavity 21 of the hollow body. The guide zone 33 exhibits a locking pawl 47 which ensures the locking of the contact in the insulating body.

This guide zone 33 is extended by two side tabs 36, 37 and a curved central tab 38.

The lateral tabs 36, 37 form pads 39, 40 adapted to ensure an electrical connection with the bulb earth (ground) contacts 4 and 6. In the case of a single-filament application, the tab 36 is removed.

The central tab 38 is folded without bending at about 175°, unlike the side tabs 36, 37. The central tab 38 exhibits a tile-shaped deformation with a cross shoulder 41 adapted to perform a hooking (latch) with the cross surface of the shoulder 8 of the lamp bulb. This tile-shaped deformation ends in a cross zone 42 positioned under the front surface of the cavity of the hollow body to prevent snagging of the tab upon insertion of the bulb.

The stopper 30 exhibits a hole 43 provided in its inner surface with lips which sealingly fit to the exterior surface of the earth wire 27.

Figure 4:
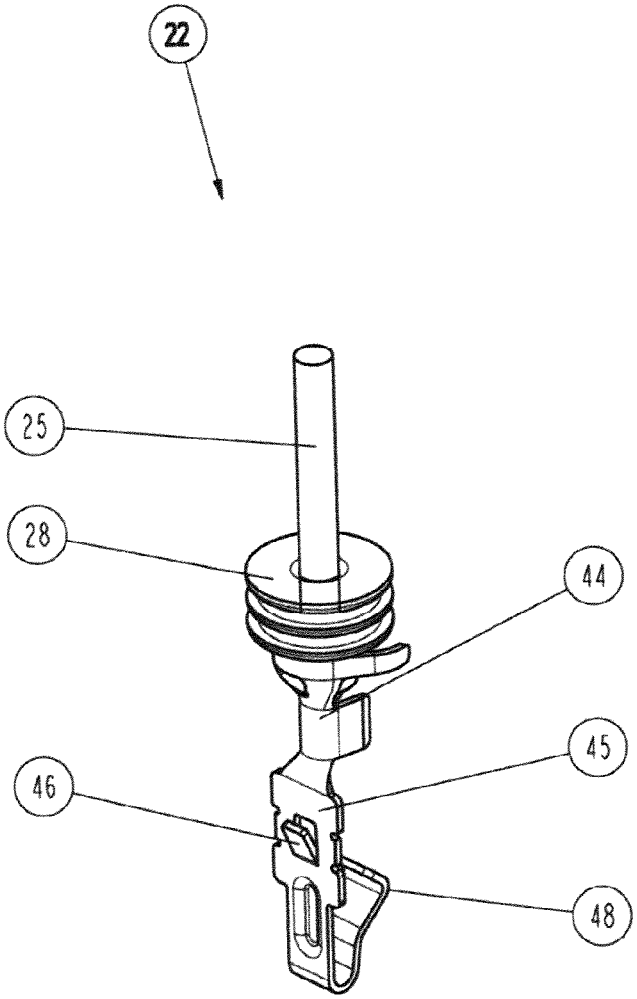
FIG. 4 shows a detailed view of the first type contact and its stopper.

FIG. 4 shows a detailed view of the supply contact 22 crimped onto the electrical wire 25 inserted into the stopper 28.

This earth contact consists of a metallic leaf, for example made of bronze, cut and folded to exhibit a crimping zone 44 extended by a rectangular guide zone 45. This guide zone 45 exhibits a locking pawl 46 which ensures the locking of the contact in the insulating body. The guide zone 45 is extended by a portion curved at about 175° to form a pad 48 adapted to ensure an electrical connection with the electrical contact 5 or 7 of the bulb.

Figure 5:
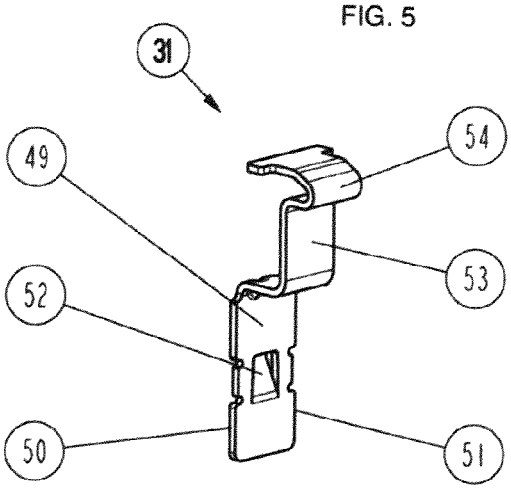
FIG. 5 shows a detailed view of the locking hook.
Figure 6:
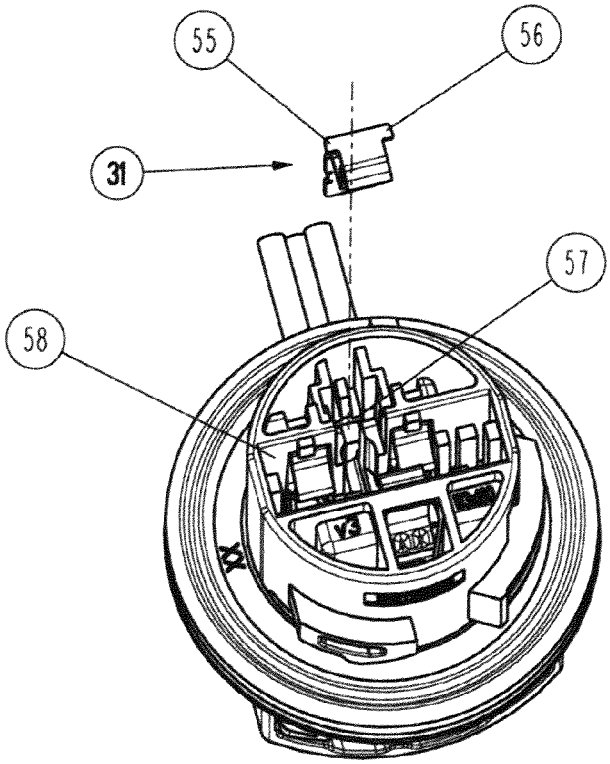
FIG. 6 shows a detailed view of the front cavity of the socket.

FIGS. 5 and 6 respectively show a detailed view of the locking hook and a view of the hollow body provided for receiving the locking hook.

The locking hook is folded and cut in a metallic sheet, or possibly another resiliently deformable material.

It exhibits a guide zone 49 of a substantially rectangular shape, with two side wings 50, 51 engaging with complementary guide rails provided in the cavity of the insulating body. A locking pawl 52 holds the hook when it is correctly engaged in the insulating body. This guide zone 49 extends into a zone 53 folded inwards, terminating with a cross shoulder 54 adapted to (latch) perform a hooking with the cross surface of the shoulder 9 of the bulb base, and thus to complete the locking provided by the earth (ground) contact.

The shoulder 54 exhibits two side tabs 55, 56 engaging into a cavity provided at the end of the receiving groove 57 provided in the insulating body. Such receiving zone opens into the cavity 58 provided for the engagement of the base 3 of the bulb 1.

The movable slide 60 consists of a hollow portion exhibiting two lateral flanks 61, 62 connected by an upper surface 63 liable to cover the upper surface of the body 10.

The lateral flanks 61, 62 exhibit, on the inner surfaces thereof, a rib the width of which corresponds to the thickness of the rails 64 provided on the side faces of the body 10 to provide guiding in translation.

In the example described, the guiding direction is perpendicular to the axis of insertion of the supply means 11, 12, 13. But the guiding direction could be inclined with respect to these axes in alternative embodiments.

The side flanks exhibit, at the front portions thereof, hooks 67, 68 perpendicular to the direction of translation of the slide 60.

These hooks form a retaining means engaging with complementary hooks 65, 66 provided on the body 10. These hooks 65, 66 and 67, 68 are respectively so configured as to limit the rearward travel of the slide 3 and to prevent the withdrawal thereof from the body 10.

The hooks 65, 66 formed on the slide 60 exhibit a bevel directed frontward, to enable the forcing and ensure the wickering and locking of the slide 60 on the body 10. In this locked position, the slide 60 prevents removal of the supply means 11, 12, 13.

Moreover, when the supply means 11, 12, 13 are not correctly engaged in the body 10, the slide cannot be engaged in the locked position, which avoids any risk of imperfect assembling of the socket.

Figure 7:
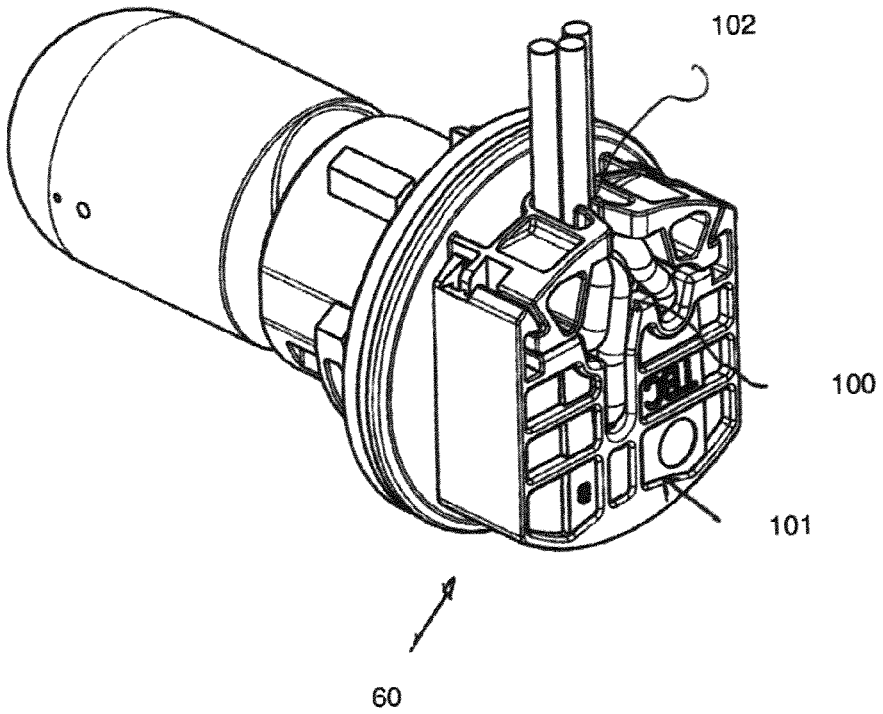
FIGS. 7 and 8 show rear views of the socket, according to an alternative solution.
Figure 8:
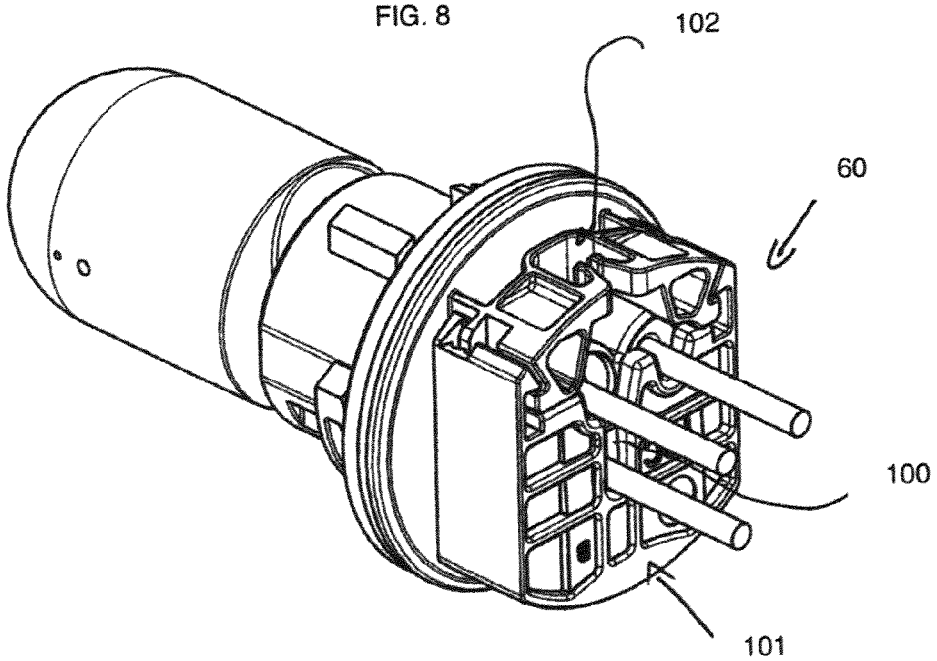

FIGS. 7 and 8 show three-quarter rear views of a socket according to an alternative solution enabling to achieve a side (FIG. 7) or axial (FIG. 8) outlet for the wires. For this purpose, the slide 60 exhibits a cavity 100 opening on the one hand onto the rear face 101 of the slide, and on the other hand onto a side cut 102.

When an axial outlet is desired, the wires go out of the slide through the opening 100 provided in the slide without being folded.

When a side outlet is desired, the wires are folded prior to the engagement of the slide 60, to go out through the cut 102.

The invention claimed is:

1. A hybrid socket for a single-filament or dual-filament bulb, said bulb comprising a bubble made of glass extended by a base made of glass and having at least one pair of wires traversing the base and each at least one pair of wires folded over one of the faces of the base to form a metallic contact parallel to a longitudinal axis of the bulb, with the socket comprising:

a body made of an insulating material, having a front cavity of substantially rectangular shape complementary to an exterior shape of the base of the bulb, the insulating body having locking pins on an exterior surface and a flange, a rear portion of said body exhibiting at least one longitudinal cavity of circular cross section and a longitudinal cavity of oblong cross section, the socket further comprising:

at least one stopper of cross section complementary to that of the cavity of circular cross section, each one of said at least one stopper being traversed by a first supply wire crimped onto a metallic contact of a first type, and another stopper of complementary cross section to that of the cavity of oblong cross section, said another stopper being traversed by a second supply wire crimped onto an earth metallic contact, wherein said cavity comprises a longitudinal groove for engagement of a locking hook for the bulb, and in that each contact of the first type comprises a metallic leaf spring folded and cut to form a current pick-up pad and a locking pawl, the earth contact comprising a metallic leaf spring folded and cut to form at least one current pick-up pad and a central tab adapted to engage with a first shoulder of the bulb, and the socket further comprising a locking hook consisting of a metallic leaf spring folded and cut to enable the insertion thereof through a front face of the insulating body, said locking hook being adapted to engage with a second shoulder of the bulb, arranged on an opposite face of the base, relative to said first shoulder.

2. The socket according to claim 1, wherein said earth contact consists of a metallic leaf spring folded and cut to form a single laterally offset current pick-up pad, and a locking hook adapted to engage with the first shoulder of the bulb, the socket further exhibiting a solid wall to close one of the cavities of circular cross section, for use with a single-filament bulb.

3. The socket according to claim 1, wherein said earth contact comprises a metallic leaf spring folded and cut to form two current pick-up pads laterally offset on either side of a median and a central tab adapted to engage with the first shoulder of the bulb for use with a dual-filament lamp.

4. The socket according to claim 1, wherein the oblong cavity is configured to engage two wings of a guide zone of said earth contact to ensure the correct positioning of the earth contact.

5. The socket according to claim 1, wherein the circular cavities are configured to ensure the correct positioning of the contacts of the first type.

6. The socket according to claim 1, wherein said front cavity for inserting the bulb exhibits lateral guide zones arranged longitudinally to ensure guiding shorter sides of the bulb base.

7. The socket according to claim 1, wherein said front cavity for introducing the bulb, exhibits adjustment protrusions positioned to come into contact with the metallic contacts of the bulb.

* * * * *